US006852017B2

(12) United States Patent
Brown

(10) Patent No.: US 6,852,017 B2
(45) **Date of Patent: *Feb. 8, 2005**

(54) METHOD AND APPARATUS FOR CHEMICAL-MECHANICAL PLANARIZATION OF MICROELECTRONIC SUBSTRATES WITH A CARRIER AND MEMBRANE

(75) Inventor: Nathan R. Brown, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 57 days.

This patent is subject to a terminal disclaimer.

(21) Appl. No.: 09/910,638

(22) Filed: Jul. 20, 2001

(65) Prior Publication Data

US 2001/0039169 A1 Nov. 8, 2001

Related U.S. Application Data

(62) Division of application No. 09/366,406, filed on Aug. 3, 1999.

(51) Int. Cl.[7] ..... B24B 1/00

(52) U.S. Cl. ..... 451/57; 451/41; 451/59; 451/63; 451/288; 451/285

(58) Field of Search ..... 451/57, 41, 59, 451/63, 288, 285

(56) References Cited

U.S. PATENT DOCUMENTS

| | | | | |
|---|---|---|---|---|
| 4,918,869 A | * | 4/1990 | Kitta | 451/288 |
| 5,081,795 A | | 1/1992 | Tanaka et al. | 51/131.1 |
| 5,449,316 A | | 9/1995 | Strasbaugh | 451/289 |
| 5,624,299 A | | 4/1997 | Shendon | 451/28 |
| 5,635,083 A | | 6/1997 | Breivogel et al. | 216/88 |
| 5,643,053 A | * | 7/1997 | Shendon | 451/28 |
| 5,730,642 A | | 3/1998 | Sandhu et al. | 451/6 |
| 5,733,182 A | | 3/1998 | Muramatsu et al. | 451/289 |
| 5,738,574 A | * | 4/1998 | Tolles et al. | 451/288 |
| 5,766,058 A | | 6/1998 | Lee et al. | 451/41 |
| 5,769,692 A | | 6/1998 | Pasch et al. | 451/41 |
| 5,769,696 A | | 6/1998 | Lee et al. | 451/287 |
| 5,769,697 A | | 6/1998 | Nishio | 451/288 |
| 5,769,699 A | * | 6/1998 | Yu | 451/528 |
| 5,791,973 A | | 8/1998 | Nishio | 451/41 |
| 5,888,120 A | | 3/1999 | Doran | 451/41 |
| 5,948,204 A | | 9/1999 | Maveety et al. | 156/345 |
| 5,961,375 A | | 10/1999 | Nagahara et al. | 451/41 |

(List continued on next page.)

FOREIGN PATENT DOCUMENTS

| | | |
|---|---|---|
| CA | 2173639 | 10/1996 |
| JP | 58-22657 A | 2/1983 |
| JP | 63052967 | 3/1998 |

*Primary Examiner*—Lee D. Wilson
*Assistant Examiner*—Alvin J Grant
(74) *Attorney, Agent, or Firm*—Dorsey & Whitney LLP

(57) ABSTRACT

A method and apparatus for planarizing a microelectronic substrate. In one embodiment, the apparatus can include a membrane formed from a compressible, flexible material, such as neoprene or silicone, and having a first portion with a thickness greater than that of a second portion. The membrane can be aligned with the microelectronic substrate to bias the microelectronic substrate against a planarizing medium such that the first portion of the membrane biases the microelectronic substrate with a greater downward force than does the second portion of the membrane. Accordingly, the membrane can compensate for effects, such as varying linear velocities across the face of the substrate that would otherwise cause the substrate to planarize in a non-uniform fashion or, alternatively, the membrane can be used to selectively planarize portions of the microelectronic substrate at varying rates.

4 Claims, 6 Drawing Sheets

U.S. PATENT DOCUMENTS

| | | | | | |
|---|---|---|---|---|---|
| 5,964,646 | A | | 10/1999 | Kassir et al. | 451/41 |
| 5,997,385 | A | | 12/1999 | Nishio | 451/56 |
| 6,019,868 | A | | 2/2000 | Kimura et al. | 156/345 |
| 6,022,268 | A | | 2/2000 | Roberts et al. | 451/548 |
| 6,027,401 | A | | 2/2000 | Saito et al. | 451/398 |
| 6,036,587 | A | | 3/2000 | Tolles et al. | 451/288 |
| 6,050,882 | A | | 4/2000 | Chen | 451/41 |
| 6,074,288 | A | | 6/2000 | Nagahara et al. | 451/384 |
| 6,074,289 | A | | 6/2000 | Murakami et al. | 451/388 |
| 6,083,090 | A | | 7/2000 | Bamba | 451/288 |
| 6,093,085 | A | * | 7/2000 | Yellitz et al. | 451/41 |
| 6,139,402 | A | | 10/2000 | Moore | 451/41 |
| 6,296,557 | B1 | * | 10/2001 | Walker | 451/526 |
| 6,296,559 | B1 | * | 10/2001 | Kinnebrew | 452/128 |
| 6,431,968 | B1 | | 8/2002 | Chen et al. | 451/398 |
| 6,439,967 | B2 | | 8/2002 | Carpenter | 451/41 |
| 6,612,903 | B2 | | 9/2003 | Korovin et al. | 451/9 |

* cited by examiner

METHOD AND APPARATUS FOR CHEMICAL-MECHANICAL PLANARIZATION OF MICROELECTRONIC SUBSTRATES WITH A CARRIER AND MEMBRANE

CROSS-REFERENCE TO RELATED APPLICATION

This application is a divisional of pending U.S. pattern application Ser. No. 09/366,406, filed Aug. 3, 1999.

TECHNICAL FIELD

The present invention relates to a carrier having a membrane for engaging microelectronic substrates during mechanical and/or chemical-mechanical planarization.

BACKGROUND OF THE INVENTION

Mechanical and chemical-mechanical planarizing processes (collectively "CMP") are used in the manufacturing of microelectronic devices for forming a flat surface on semiconductor wafers, field emission displays and many other microelectronic-device substrates and substrate assemblies. FIG. 1 schematically illustrates a CMP machine 10 having a platen 20. The platen 20 supports a planarizing medium 40 that can include a polishing pad 41 having a planarizing surface 42 on which a planarizing liquid 43 is disposed. The polishing pad 41 may be a conventional polishing pad made from a continuous phase matrix material (e.g., polyurethane), or it may be a new generation fixed-abrasive polishing pad made from abrasive particles fixedly dispersed in a suspension medium. The planarizing liquid 43 may be a conventional CMP slurry with abrasive particles and chemicals that remove material from the wafer, or the planarizing liquid may be a planarizing solution without abrasive particles. In most CMP applications, conventional CMP slurries are used on conventional polishing pads, and planarizing solutions without abrasive particles are used on fixed abrasive polishing pads.

The CMP machine 10 can also include an under-pad 25 attached to an upper surface 22 of the platen 20 and the lower surface of the polishing pad 41. A drive assembly 26 rotates the platen 20 (as indicated by arrow A), and/or it reciprocates the platen 20 back and forth (as indicated by arrow B). Because the polishing pad 41 is attached to the under-pad 25, the polishing pad 41 moves with the platen 20.

A wafer carrier 30 is positioned adjacent the polishing pad 41 and has a lower surface 32 to which a substrate 12 may be attached via suction. Alternatively, the substrate 12 may be attached to a resilient pad 34 positioned between the substrate 12 and the lower surface 32. The wafer carrier 30 may be a weighted, free-floating wafer carrier, or an actuator assembly 33 may be attached to the wafer carrier to impart axial and/or rotational motion (as indicated by arrows C and D, respectively).

To planarize the substrate 12 with the CMP machine 10, the wafer carrier 30 presses the substrate 12 face-downward against the polishing pad 41. While the face of the substrate 12 presses against the polishing pad 41, at least one of the platen 20 or the wafer carrier 30 moves relative to the other to move the substrate 12 across the planarizing surface 42. As the face of the substrate 12 moves across the planarizing surface 42, material is continuously removed from the face of the substrate 12.

CMP processes should consistently and accurately produce a uniformly planar surface on the substrate to enable precise fabrication of circuits and photo-patterns. During the fabrication of transistors, contacts, interconnects and other features, many substrates develop large "step heights" that create a highly topographic surface across the substrate. Yet, as the density of integrated circuits increases, it is necessary to have a planar substrate surface at several stages of processing the substrate because non-uniform substrate surfaces significantly increase the difficulty of forming sub-micron features. For example, it is difficult to accurately focus photo-patterns to within tolerances approaching 0.1 $\mu$m on non-uniform substrate surfaces because sub-micron photolithographic equipment generally has a very limited depth of field. Thus, CMP processes are often used to transform a topographical substrate surface into a highly uniform, planar substrate surface.

In the competitive semiconductor industry, it is also highly desirable to have a high yield in CMP processes by producing a uniformly planar surface at a desired endpoint on a substrate as quickly as possible. For example, when a conductive layer on a substrate is under-planarized in the formation of contacts or interconnects, many of these components may not be electrically isolated from one another because undesirable portions of the conductive layer may remain on the substrate over a dielectric layer. Additionally, when a substrate is over-planarized, components below the desired endpoint may be damaged or completely destroyed. Thus, to provide a high yield of operable microelectronic devices, CMP processing should quickly remove material until the desired endpoint is reached.

The planarity of the finished substrate and the yield of CMP processing is a function of several factors, one of which is the rate at which material is removed from the substrate (the "polishing rate"). Although it is desirable to have a high polishing rate to reduce the duration of each planarizing cycle, the polishing rate should be uniform across the substrate to produce a uniformly planar surface. The polishing rate should also be consistent to accurately endpoint CMP processing at a desired elevation in the substrate. The polishing rate, therefore, should be controlled to provide accurate, reproducible results.

In certain applications, the polishing rate is a function of the relative velocity between the microelectronic substrate 12 and the polishing pad 41. For example, where the carrier 30 and the substrate 12 rotate relative to the polishing pad 41, the polishing rate may be higher toward the periphery of the substrate 12 than toward the center of the substrate 12 because the relative linear velocity between the rotating substrate 12 and the polishing pad 41 is higher toward the periphery of the substrate 12. Where other methods are used to generate relative motion between the substrate 12 and the planarizing medium 40, other portions of the substrate 12 may planarize at higher rates. In any case, spatial non-uniformity in the polishing rate can reduce the overall planarity of the substrate 12.

One conventional method for improving the uniformity of the polishing rate across the face of the substrate 12 is to vary the normal force (and therefore the frictional force) between the substrate 12 and the polishing pad 41 to account for the different relative velocities between the two. For example, in one conventional arrangement shown in FIG. 2, a carrier 30*a* can include a plurality of downward facing jets 35 (shown schematically in FIG. 2) that can direct high pressure air through a small cavity 39 and against the backside of the substrate 12, pressing the substrate 12 against the polishing pad 41. In one aspect of this arrangement, selected jets 35 can be closed or opened to vary the normal force applied to the substrate 12. For example, where it is desirable to reduce the normal force applied toward the periphery of the substrate 12 (relative to the normal force applied to the center of the substrate 12), selected jets 35 aligned with the periphery of the substrate 12 can be closed. One drawback with this approach is that it may be difficult and/or time consuming to change the number and/or location of the closed jets when the carrier 30*a* planarizes different types of substrates 12. A further drawback is that it may be difficult to accurately control the pressure applied by the jets because of the flow of gas from the jets 35 in the cavity 39 can be highly turbulent and unpredictable.

Another approach to varying the normal force applied to the substrate 12 is to use pressurized bladders, as shown in FIG. 3. For example, in one conventional approach, a carrier 30*b* can include a central bladder 36*a* aligned with the central portion of the substrate 12 and an annular peripheral bladder 36*b* aligned with the periphery of the substrate 12. The carrier 30*b* can also include an annular retaining ring 37 that is biased against the polishing pad 41 by an annular retainer bladder 36*c*. Each of the bladders 36*a*–36*c* is coupled with a corresponding conduit 38*a*–38*c* to a separately regulated pressure source. Accordingly, the pressure applied to the central bladder 36*a* can be increased relative to the pressure supplied to the peripheral bladder 36*b* to increase the normal force at the center of the substrate 12 and account for the lower relative velocity between the substrate 12 and the polishing pad 41 near the center of the substrate 12. One drawback with this approach is that it can be cumbersome to couple several different high pressure supply conduits to the rotating carrier 30*b*. Furthermore, it may be difficult to change the relative sizes of the bladders where it is desirable to change the relative sizes of portions of the substrate 12 subjected to different pressures.

SUMMARY OF THE INVENTION

The present invention is directed towards methods and apparatuses for planarizing microelectronic substrates. In one aspect of the invention, the apparatus can include a carrier for supporting the microelectronic substrate relative to a planarizing medium during planarization of the substrate. The carrier can include a support member and a flexible, compressible membrane adjacent to the support member and having a first portion with a first thickness and a second portion with a second thickness greater than the first thickness. The first portion of the membrane can be aligned with a first part of the microelectronic substrate and the second portion can be aligned with a second part of the microelectronic substrate when the membrane engages the microelectronic substrate. Accordingly, the second portion of the membrane can exert a greater normal force against the second part of the microelectronic substrate than the first portion of the membrane exerts against the first part of the substrate.

In one aspect of the invention, the membrane can be inflated to bias it against the microelectronic substrate. Alternatively, the membrane can be biased by a flat support plate. In another aspect of the invention, the thicket portion of the membrane can be aligned with a central part of the microelectronic substrate and the thinner portion of the membrane can be aligned with a peripheral part of the substrate positioned radially outwardly from the central part. Alternatively, the positions of the thicker and thinner portions of the membrane can be reversed. In any case, the membrane can include neoprene, silicone or another compressible, flexible material and can be used in conjunction with a web-format planarizing machine or a circular platen planarizing machine.

DETAILED DESCRIPTION OF THE INVENTION

The present disclosure describes methods and apparatuses for mechanical and/or chemical-mechanical planarization of substrates used in the fabrication of microelectronic devices. Many specific details of certain embodiments of the invention are set forth in the following description and in FIGS. 4–8 to provide a thorough understanding of the embodiments described herein. One skilled in the art, however, will understand that the present invention may have additional embodiments, or that the invention may be practiced without several of the details described in the following description.

Figure 4:
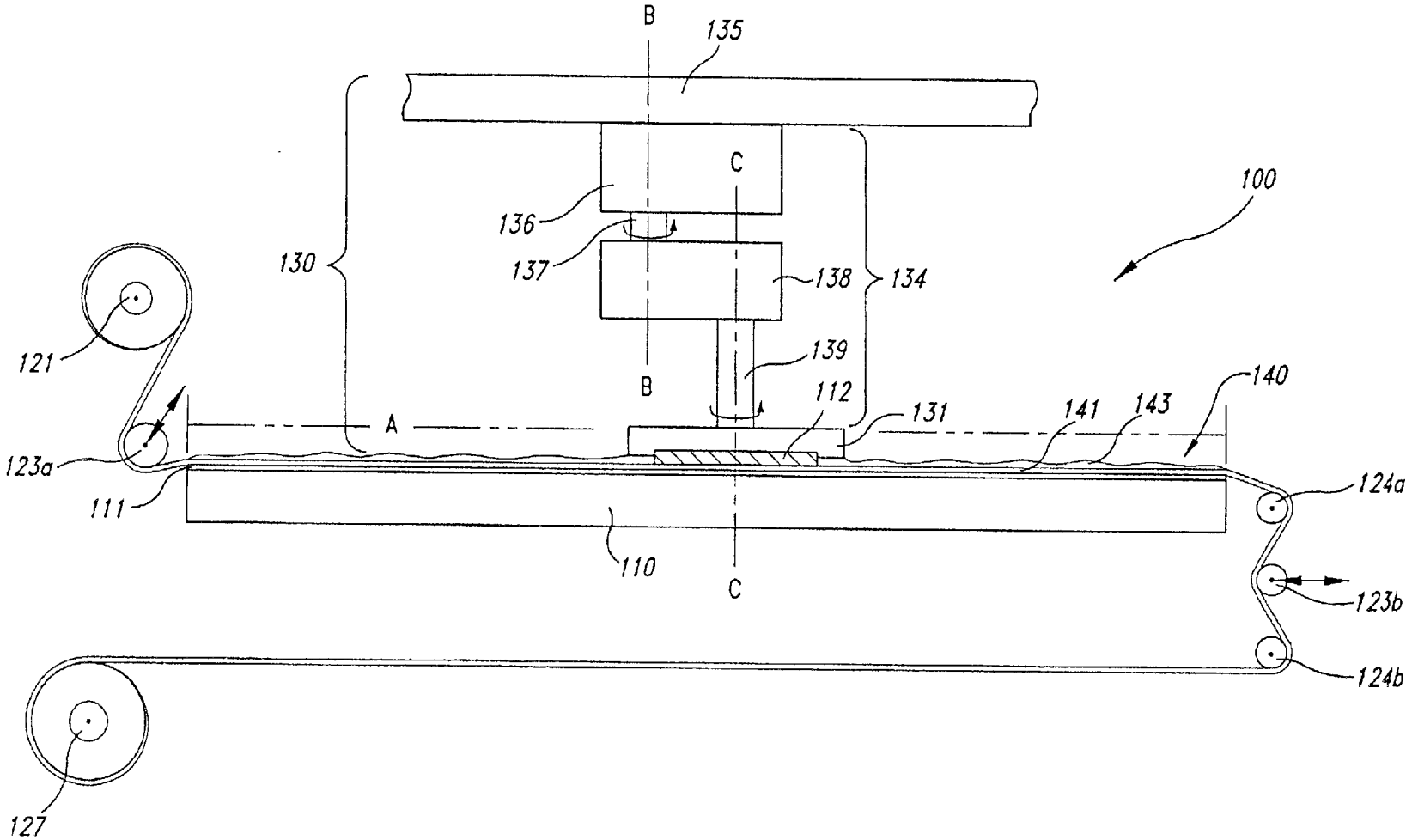
FIG. 4 is a partially schematic, partial cross-sectional side elevation view of a planarizing machine having a carrier in accordance with an embodiment of the invention.

FIG. 4 is a partially schematic, partial cross-sectional side elevation view of a planarizing machine 100 having a carrier 130 that presses a substrate 112 against a planarizing medium 140 in accordance with an embodiment of the invention. The substrate 112 can include a single unit of semiconductor material, such as silicon, or a semiconductor material in combination with conductive materials, insulative materials, dielectric materials, and/or other materials that are applied to the substrate during processing. The features and advantages of the carrier 130 are best understood in the context of the structure and the operation of the planarizing machine 100. Thus, the general features of the planarizing machine 100 will be described initially.

The planarizing machine 100 is a web-format planarizing machine with a support table 110 having a top-panel 111 at a workstation where an operative portion "A" of the polishing pad 141 is positioned. The top-panel 111 is generally a rigid plate that provides a flat, solid surface to which a particular section of the polishing pad 141 may be secured during planarization. The planarizing machine 100 also has a plurality of rollers to guide, position and hold the polishing pad 141 over the top-panel 111. In one embodiment, the rollers include a supply roller 121, first and second idler rollers 123*a* and 123*b*, first and second guide rollers 124*a* and 124*b* and a take-up roller 127. The supply roller 121 carries an unused or pre-operative portion of the polishing pad 141 and the take-up roller 127 carries a used or post-operative portion of the polishing pad 141. Additionally, the first idler roller 123*a* and the first guide roller 124*a* stretch the polishing pad 141 over the top-panel 111 to hold the polishing pad 141 stationary during operation. A motor (not shown) drives the take-up roller 127 and can also drive the supply roller 121 to sequentially advance the polishing pad 141 across the top-panel 111. Accordingly, clean post-operative sections of the polishing pad 141 may be quickly substituted for worn sections to provide a consistent surface for planarizing and/or cleaning the substrate 112.

The carrier assembly 130 translates and/or rotates the substrate 112 across the polishing pad 141. In one embodiment, the carrier assembly 130 has a substrate holder or support 131 to hold the substrate 112 during planarization. The carrier assembly 130 can also have a support gantry 135 carrying a drive assembly 134 that translates along the gantry 135. The drive assembly 134 generally has an actuator 136, a drive shaft 137 coupled to the actuator 136, and an arm 138 projecting from the drive shaft 137. The arm 138 carries the substrate holder 131 via a terminal shaft 139. In another embodiment, the drive assembly 134 can also have another actuator (not shown) to rotate the terminal shaft 139 and the substrate holder 131 about an axis C—C as the actuator 136 orbits the substrate holder 131 about the axis B—B. One suitable planarizing machine without the polishing pad 141 and the planarizing liquid 143 is manufactured by Obsidian, Incorporated of Fremont, Calif. In light of the embodiments of the planarizing machine 100 discussed above, a specific embodiment of the carrier assembly 130 will now be described in more detail.

Figure 5:
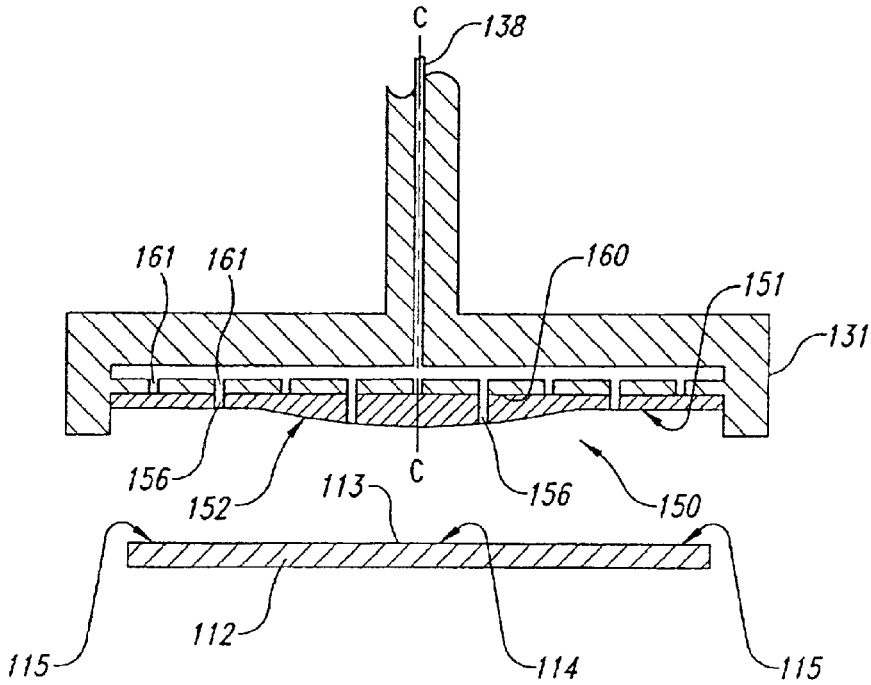
FIG. 5 is a detailed cross-sectional side elevation view of a portion of the carrier shown in FIG. 4 positioned above a microelectronic substrate.

FIG. 5 is a detailed cross-sectional side elevation view of the substrate holder 131 shown in FIG. 4 positioned above the substrate 112. The substrate holder 131 can include a membrane 150 having a generally circular planform shape that bears against an upper surface 113 of the substrate 112 to prevent the substrate 112 from moving relative to the substrate holder 131. In one aspect of this embodiment, the membrane 150 can include a resilient, flexible material, such as neoprene or silicone, that compresses as the substrate holder 131 moves downwardly against the substrate 112. Alternatively, the membrane 150 can include other resilient, flexible, compressible materials suitable for contact with the substrate 112 and the planarizing liquid 143 (FIG. 4). In any case, the membrane 150 can have one portion that is thicker than another to apply different normal forces to different portions of the substrate 112. For example, the membrane 150 can have a central portion 152 that is thicker than a concentric, annular peripheral portion 151 located radially outwardly from the central portion 152. Accordingly, when the substrate holder 131 engages the substrate 112, the central portion 152 compresses by a greater amount than the peripheral portion 151 and exerts a greater downward force on a central part 114 of the substrate 112 than on an annular peripheral part 115 of the substrate 112.

As the substrate 112 and the substrate holder 131 rotate together relative to the polishing pad 141 (FIG. 4), the greater downward force applied to the central part 114 of the substrate 112 can locally increase the frictional forces between the substrate 112 and the polishing pad 141, and can reduce or eliminate any disparity between the removal rate of material from the central part 114 and the peripheral part 115 of the substrate 112. Such disparities can occur where the peripheral part 115 has a greater linear velocity relative to the polishing pad 141 than does the central part 114.

In one embodiment, the peripheral portion 151 of the membrane 150 can have a thickness of approximately 0.030 inches and the central portion 152 of the membrane 150 can have a thickness greater than about 0.030 inches and less than about 0.060 inches. In one aspect of this embodiment, the thickness of the membrane can vary in a generally continuous manner between the two portions. In other embodiments, portions of the membrane 150 can have other thicknesses, depending on the compressibility of the material forming the membrane 150 and the normal force selected to be applied to each portion of the substrate 112. The membrane can also have different thickness profiles, for example, a step change in thickness between the two portions, or a series of step changes between the periphery and the center of the membrane 150.

In one embodiment, the membrane 150 can include a single piece of compressible material injection molded or otherwise formed to have the cross-sectional shape shown in FIG. 5 and positioned loosely against a lower surface 160 of the substrate holder 131. As the substrate holder 131 biases the membrane 150 against the substrate 112, frictional forces between the lower surface 160 and the membrane 150, and between the membrane 150 and the substrate 112 can prevent these components from rotating relative to each other. Alternatively, other methods can be used to couple the membrane 150 to the substrate holder 131 and/or couple the substrate 112 to the membrane 150. For example, the substrate holder 131 can have holes 161 in the lower surface 160 that are coupled via a conduit 138 to a vacuum source for drawing the membrane 150 against the substrate holder 131 under a vacuum force. In another aspect of this embodiment, the membrane 150 can include perforations 156 that extend through the membrane 150 and are in fluid communication with the vacuum source to draw the substrate 112 against the membrane 150. Accordingly, the substrate 112 can remain engaged with the substrate holder 131 as the substrate holder 131 is lifted from the polishing pad 141.

One feature of the substrate holder 131 discussed above with reference to FIGS. 4 and 5 is that the membrane 150 can apply a different normal force to one portion of the substrate 112 than to another. Accordingly, the substrate holder 131 and the membrane 150 can planarize the entire substrate 112 at a more uniform rate by compensating for other effects (such as one portion of the substrate 112 having a different linear velocity than another portion) that might otherwise lead to a non-uniform planarizing rate. For example, the central portion 152 of the substrate 112 can planarize at approximately the same rate as the peripheral portion 151. An advantage of this feature is that the membrane 150 can apply differential normal forces without requiring complex rotating air supply arrangements, as is the case with some conventional systems. Another advantage is that the membrane 150 can be easily exchanged for another membrane to change the normal force distribution applied to the substrate 112. For example, a membrane 150 having one ratio of central portion thickness to peripheral portion thickness can be exchanged for another membrane having a different ratio to more effectively planarize a different substrate 112 having different surface characteristics, such as a softer peripheral part 115 and/or a harder central part 114.

Figure 6:
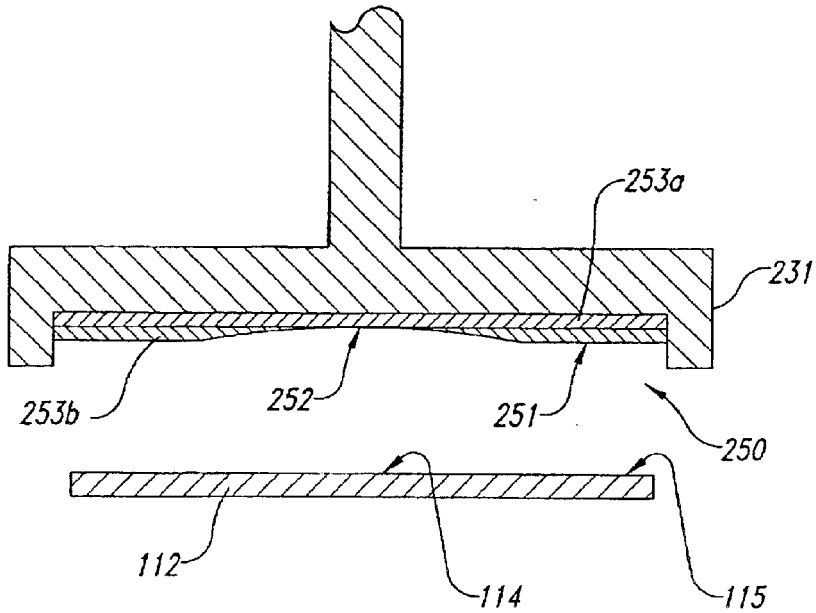
FIG. 6 is a cross-sectional side elevation view of a portion of a carrier in accordance with another embodiment of the invention positioned above a microelectronic substrate.

FIG. 6 is a cross-sectional side elevation view of a substrate holder 231 having a membrane 250 in accordance with another embodiment of the invention. The membrane 250 includes a peripheral portion 251 having a thickness greater than that of a central portion 252. Accordingly, the membrane 250 will tend to exert a greater force on the peripheral part 115 of the substrate 112 than on the central part 114. This embodiment may be suitable for planarizing microelectronic substrates 112 having features toward the periphery thereof that require a higher planarizing rate than can be achieved by the higher linear velocity at the periphery.

As shown in FIG. 6, the membrane 250 can include two plies 253 of compressible material, shown as an upper ply 253*a* and a lower ply 253*b*. The upper ply 253*a* can have a generally circular shape and the lower ply 253*b* can have a generally annular shape with a central opening. The two plies 253 can be attached using conventional adhesives. In one embodiment, the materials forming both plies 253 can be identical. Alternatively, the lower ply 253*b* can include a different material than the upper ply 253*a*, providing another method (in addition to varying the membrane thickness) for locally changing the normal force applied by the membrane 250.

Figure 7:
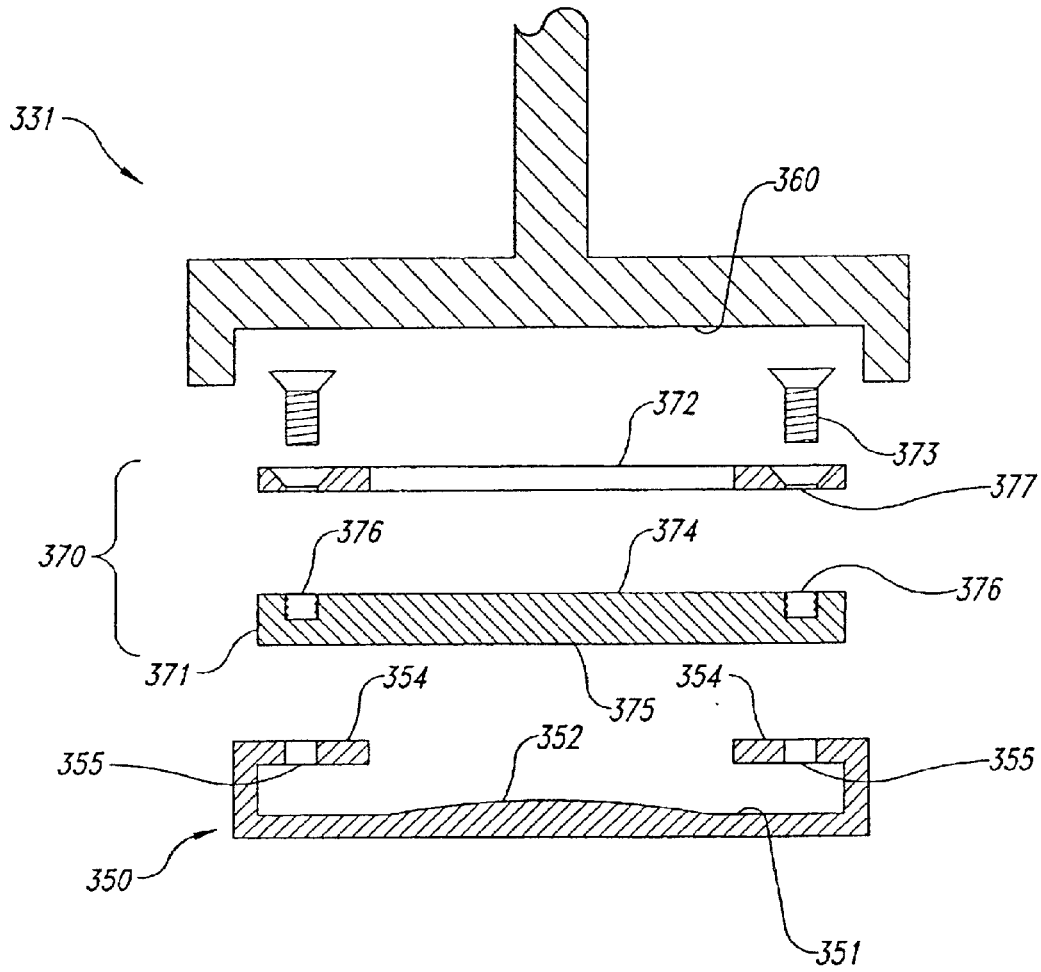
FIG. 7 is an exploded cross-sectional side elevation view of a portion of a carrier in accordance with still another embodiment of the invention.

FIG. 7 is an exploded cross-sectional side elevation view of a substrate holder 331 having a membrane 350 coupled to a retainer assembly 370 in accordance with another embodiment of the invention. The retainer assembly 370 can include a support plate 371 and a retainer ring 372 that removably clamps the membrane 350 to the support plate 371. The retainer assembly 370 then fits against a lower surface 360 of the substrate holder 331. The support plate 371 can have an upper surface 374 and a lower surface 375 facing opposite the upper surface 374. The support plate 371 can include a plurality of threaded apertures 376 (two of which are visible in FIG. 7) adjacent the outer edge of upper surface 374. The retainer ring 372 can have non-threaded apertures 377 aligned with the threaded apertures 376 of the support plate 371.

The membrane 350 can have a central portion 352, a peripheral portion 351, and an overlapping attachment portion 354 that extends over the peripheral portion 351. The attachment portion 354 can be spaced apart from the peripheral portion 351 by a distance approximately equal to the thickness of the support plate 371. Accordingly, the membrane 350 can be secured to the retainer assembly 370 by positioning the attachment portion 354 of the membrane 350 adjacent the upper surface 374 of the support plate 371, and positioning the peripheral portion 351 and central portion 352 of the membrane 350 adjacent the lower surface 375 of the support plate 371. The retainer ring 372 is then positioned on the attachment portion 354 and fasteners 373 extend through the apertures 377 of the retainer ring 372, through holes 355 of the attachment portion 354 and into the threaded apertures 376 of the support plate 371, clamping the membrane 350 between the retaining ring 372 and the support plate 371.

In one aspect of the embodiment shown in FIG. 7, the central portion 352 can bulge upwardly before the membrane 350 is mounted to the retainer assembly 370 and bulge downwardly after the membrane 350 has been mounted to the support plate 371. Alternatively, the central portion 352 can bulge downwardly before the membrane 350 is mounted to the retainer assembly 370, in a manner generally similar to that shown in FIG. 5. In another alternate arrangement, the central portion 352 can be thinner than the peripheral portion 351, in a manner generally similar to that shown in FIG. 6.

Figure 8:
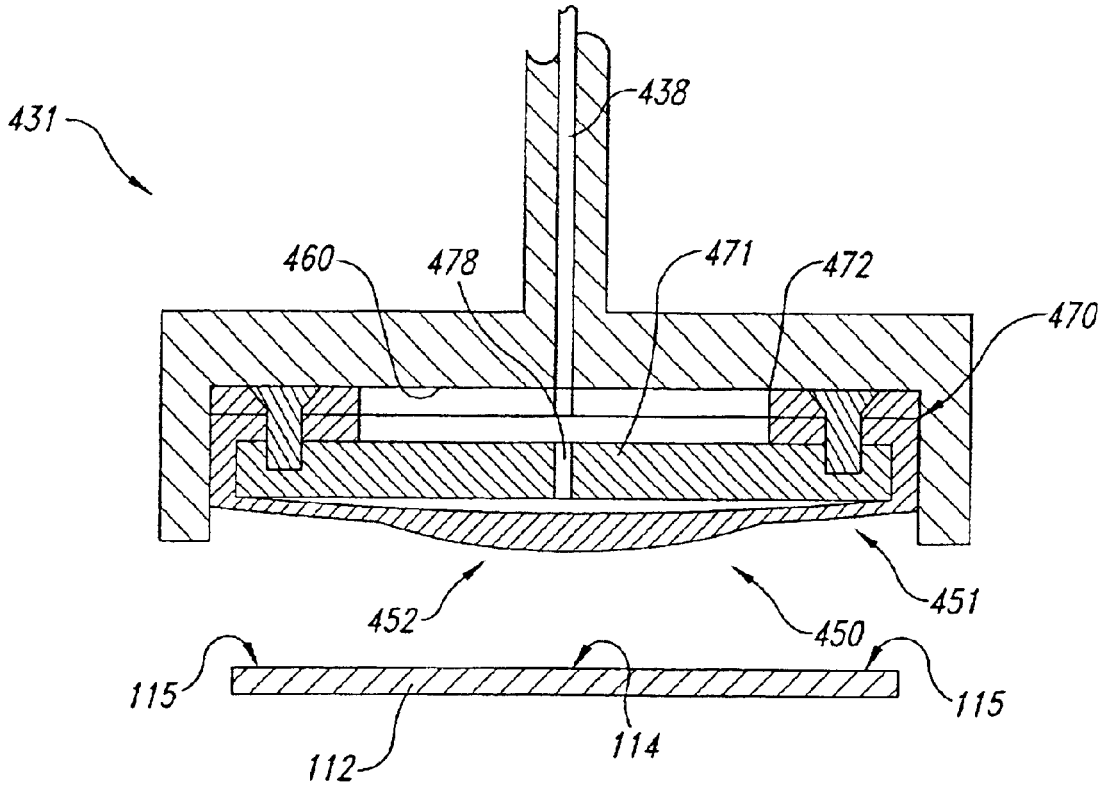
FIG. 8 is a cross-sectional side elevation view of a portion of a carrier in accordance with yet another embodiment of the invention positioned above a substrate.

FIG. 8 is a cross-sectional side elevation view of a substrate holder 431 having an inflatable membrane 450 in accordance with still another embodiment of the invention. In one aspect of this embodiment, the inflatable membrane 450 can have a central portion 452 that is thicker than a peripheral portion 451. The membrane 450 can be attached to a retainer assembly 470 having a support plate 471 and a retainer ring 472 in a manner generally similar to that discussed above with reference to the membrane 350 and the retainer assembly 370 shown in FIG. 7.

In one aspect of this embodiment, an air supply conduit 438 extends through a lower surface 460 of the substrate holder 431 and is coupled to a source of compressed air (not shown). The support plate 471 can include a corresponding air supply passage 478 that extends through the support plate 471 and is in fluid communication with the air supply conduit 438. When air (or another gas) is supplied through the air supply conduit 438 and the air supply passage 478, the membrane 450 will tend to inflate, increasing the normal force applied to the substrate 112. The increased normal force will be greater at the central part 114 of the substrate 112 than at the peripheral part 115 due to the increased thickness of the membrane 450 at the central portion 452 thereof.

Figure 1:
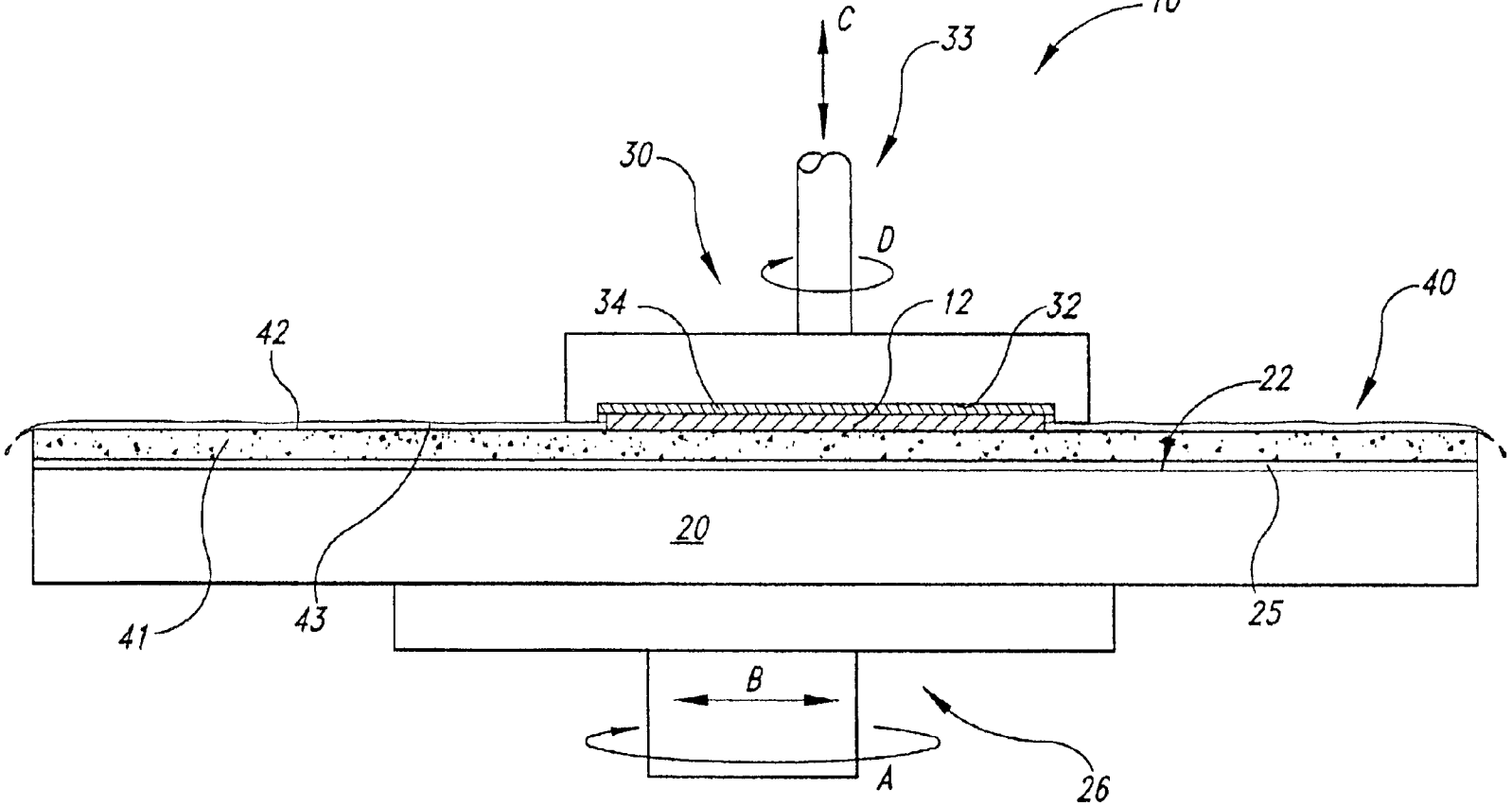
Fig. 1 (Prior Art)
FIG. 1 is a partially schematic, partial cross-sectional side elevation view of a planarizing machine in accordance with the prior art.
Figure 2:
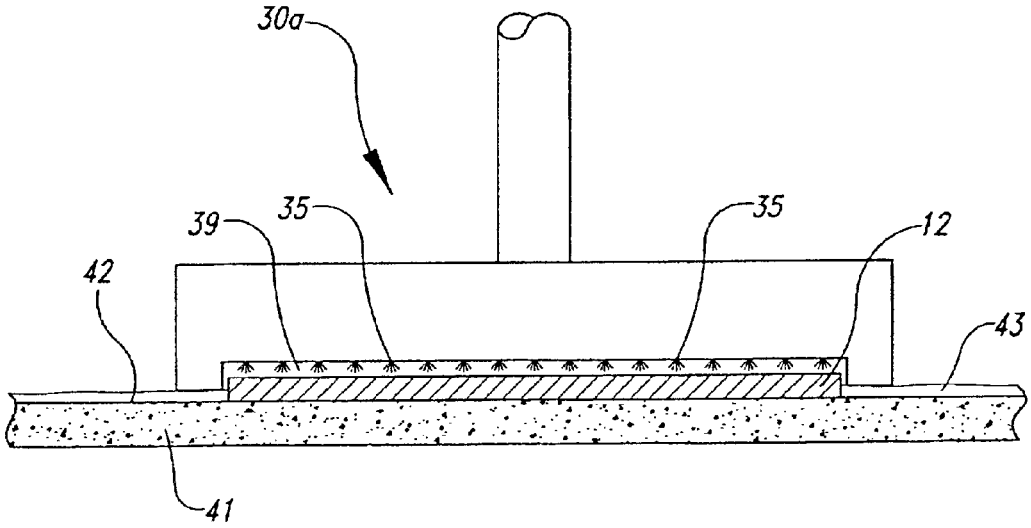
Fig. 2 (Prior Art)
FIG. 2 is a partially schematic, partial cross-sectional side elevation view of a portion of another planarizing machine in accordance with the prior art.
Figure 3:
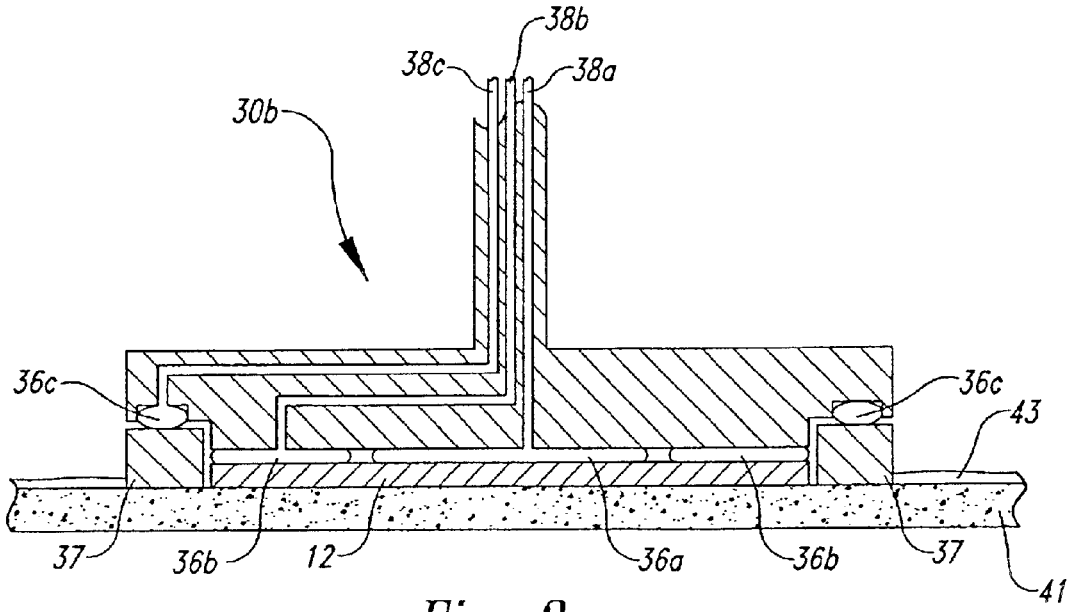
Fig. 3 (Prior Art)
FIG. 3 is a partially schematic, partial cross-sectional side elevation view of a portion of still another planarizing machine in accordance with the prior art.

From the foregoing it will be appreciated that, although specific embodiments of the invention have been described herein for purposes of illustration, various modifications may be made without deviating from the spirit and scope of the invention. For example, the membrane can have non-circular planform shapes and the thick and thin regions of the membrane need not be concentric or annular. The substrate holder can be used with a web-format planarizing machine of the type shown in FIG. 4, or a circular platen planarizing machine of the type shown in FIG. 1. Accordingly, the invention is not limited except as by the appended claims.

What is claimed is:

1. A method for removing material from a microelectronic substrate, comprising:

providing a substrate holder that carries the microelectronic substrate and at least one membrane having a first membrane portion and a second membrane portion, the at least one membrane disposed between the substrate holder and the microelectronic substrate;

engaging the microelectronic substrate with a planarizing medium;

moving at least one of a first part of the microelectronic substrate and a first portion of the planarizing medium relative to the other at a first rate;

moving at least one of a second part of the microelectronic substrate and the first portion of the planarizing medium relative to the other at a second rate less than the first rate;

advancing the planarizing medium from a supply roller to a take up roller to engage a second portion of the planarizing medium with the first and second parts of the microelectronic substrate; and removing material from the first and second parts of the microelectronic substrate at approximately equal rates by biasing the first part of the microelectronic substrate against the planarizing medium with the first membrane portion having a first thickness and biasing the second part of the microelectronic substrate against the planarizing medium with the second membrane portion having a second thickness greater than the first thickness.

2. The method of claim 1 wherein engaging the microelectronic substrate with the planarizing medium includes engaging the microelectronic substrate with a polishing pad.

3. The method of claim 1 wherein moving at least one of the first part of the microelectronic substrate and the planarizing medium includes moving at least one of a first annular part of the microelectronic substrate and the planarizing medium, further wherein moving at least one of the second part of the microelectronic substrate and the planarizing medium includes moving at least one of the planarizing medium and a second annular part of the microelectronic substrate positioned radially inwardly from the first annular part of the microelectronic substrate.

4. The method of claim 1 wherein the at least one membrane has a first surface facing toward the microelectronic substrate and a second surface facing generally opposite the first surface, further wherein biasing the microelectronic substrate against the planarizing medium includes biasing a generally flat support member against the second surface of the membrane.

* * * * *

UNITED STATES PATENT AND TRADEMARK OFFICE

CERTIFICATE OF CORRECTION

PATENT NO. : 6,852,017 B2
APPLICATION NO. : 09/910638
DATED : February 8, 2005
INVENTOR(S) : Nathan R. Brown It is certified that error appears in the above-identified patent and that said Letters Patent is hereby corrected as shown below:

| Column, Line | Reads | Should Read |
|---|---|---|
| Title Page | | |
| Item (56), U.S. Patent Documents | [Omitted references] | --6,290,572 B1 9/2001<br>Hofmann.....451/5<br>5,769,699 6/1998<br>Yu.....451/528<br>6,135,858 10/2000<br>Takahashi.....451/41-- |
| Column 3, Line 57 | "the thicket portion" | --the thicker portion-- |
| Colum 8, Line 66 | [Omitted claims] | --**5.** A method for removing material from a microelectronic substrate, comprising: providing a substrate holder that carries the microelectronic substrate and at least one membrane having a first membrane portion and a second membrane portion, the at least one membrane disposed between the substrate holder and the microelectronic substrate;<br>engaging the microelectronic substrate with a planarizing medium;<br>moving at least one of a first part of the microelectronic substrate and the planarizing medium relative to the other at a first rate;<br>moving at least one of a second part of the microelectronic substrate and the planarizing medium relative to the other at a second rate less than the first rate; and |

UNITED STATES PATENT AND TRADEMARK OFFICE

CERTIFICATE OF CORRECTION

PATENT NO. : 6,852,017 B2
APPLICATION NO. : 09/910638
DATED : February 8, 2005
INVENTOR(S) : Nathan R. Brown It is certified that error appears in the above-identified patent and that said Letters Patent is hereby corrected as shown below:

(cont'd)

removing material from the first and second parts of the microelectronic substrate at approximately equal rates by biasing the first part of the microelectronic substrate against the planarizing medium with the first membrane portion having a first thickness and biasing the second part of the microelectronic substrate against the planarizing medium with the second membrane portion having a second thickness greater than the first thickness.

6. The method of claim 5 wherein engaging the microelectronic substrate with the planarizing medium includes engaging the microelectronic substrate with a polishing pad

7. The method of claim 5 wherein moving at least one of the first part of the microelectronic substrate and the planarizing medium includes moving at least one of a first annular part of the microelectronic substrate and the planarizing medium, further wherein moving at least one of the second part of the microelectronic substrate and the planarizing medium includes moving at least one of the planarizing medium and a second annular part of the microelectronic substrate positioned radially inwardly from the first annular part of the microelectronic substrate.

8. The method of claim 5 wherein the at least one membrane has a first surface facing toward the microelectronic substrate and a second surface facing generally opposite the first surface, further wherein biasing the microelectronic substrate against the planarizing medium includes biasing a generally flat support member against the second surface of the membrane.

UNITED STATES PATENT AND TRADEMARK OFFICE

CERTIFICATE OF CORRECTION

PATENT NO. : 6,852,017 B2
APPLICATION NO. : 09/910638
DATED : February 8, 2005
INVENTOR(S) : Nathan R. Brown It is certified that error appears in the above-identified patent and that said Letters Patent is hereby corrected as shown below:

(cont'd)

9. The method of claim 5 wherein biasing the microelectronic substrate against a planarizing medium includes biasing the microelectronic substrate against a first portion of a polishing pad, further wherein moving at least one of the microelectronic substrate and the planarizing medium includes advancing the polishing pad from a supply roller to a take-up roller to engage a second portion of the polishing pad with the first and second parts of the microelectronic substrate.--

Signed and Sealed this

Twenty-sixth Day of December, 2006

JON W. DUDAS
*Director of the United States Patent and Trademark Office*